US006650039B1

(12) United States Patent
Kim et al.

(10) Patent No.: US 6,650,039 B1
(45) Date of Patent: Nov. 18, 2003

(54) ELECTRON GUN IN COLOR CATHODE RAY TUBE

(75) Inventors: Tae Kyu Kim, Kyongsangbuk-do (KR); Hyun Cheol Kim, Kyongsangbuk-do (KR)

(73) Assignee: LG Electronics Inc., Seoul (KR)

( * ) Notice: Subject to any disclaimer, the term of this patent is extended or adjusted under 35 U.S.C. 154(b) by 239 days.

(21) Appl. No.: 09/589,889

(22) Filed: Jun. 9, 2000

(30) Foreign Application Priority Data

Jun. 11, 1999 (KR) ..... 1999-21821

(51) Int. Cl.[7] ..... H01J 29/50
(52) U.S. Cl. ..... 313/414; 313/412; 313/413
(58) Field of Search ..... 313/409, 412–414, 313/421, 426

(56) References Cited

U.S. PATENT DOCUMENTS 5,404,071 A * 4/1995 Son ..... 313/414
5,986,394 A * 11/1999 Jeon et al. ..... 313/413
6,031,346 A * 2/2000 Shirai et al. ..... 313/414
6,051,919 A * 4/2000 Shirai et al. ..... 313/412
6,051,920 A * 4/2000 Kim et al. ..... 313/412

* cited by examiner

*Primary Examiner*—Kenneth J. Ramsey
*Assistant Examiner*—Anthony Perry
(74) *Attorney, Agent, or Firm*—Fleshner & Kim, LLP

(57) ABSTRACT

An electron gun is provided for a color CRT having a triode for emitting, controlling, and accelerating R, G, B beams, and main lens forming electrodes for focusing the R, G, B beams emitted from the triode onto a screen. The electron gun includes first dynamic quadrupole lens forming electrodes for providing a vertical focusing action and a horizontal focusing action to be applied to the R, G, B beams such that the vertical focusing action is different from the horizontal focusing action, and second dynamic quadrupole lens forming electrodes for providing horizontal/vertical focusing actions to be applied to the R, B beams, side beams, and horizontal/vertical focusing actions to be applied to the G beam, a center beam, the horizontal/vertical focusing actions to be applied to the R, B beams being different from the horizontal/vertical focusing actions to be applied to the G beam. The first dynamic quadrupole lens forming electrodes and the second dynamic quadrupole lens forming electrodes being are arranged in order starting from the main lens forming electrodes toward the triode, thereby enhancing a resolution.

18 Claims, 9 Drawing Sheets

ELECTRON GUN IN COLOR CATHODE RAY TUBE

BACKGROUND OF THE INVENTION

1. Field of the Invention

The present invention relates to a cathode ray tube, and more particularly, to an electron gun in a color CRT(Cathode Ray Tube) for enhancing a resolution.

2. Background of the Related Art

In general, as shown in FIG. 1, the color CRT is provided with a panel 1, a funnel 2 of a bulb form welded to an inside surface of the panel, and a neck portion 5 at a rear of the funnel for sealing in the electron gun 4 to emit R. G. B beams 3 of red, green and blue colors. There is a coat 6 of fluorescent material of red, green, and blue colors on an inside surface of the panel, a support frame 8 in the vicinity of the coat of fluorescent material, and a shadow mask 7 fitted to the support frame 8 for selecting a color from the R. G. B beams 3 emitted from the electron gun 4. There is a deflection yoke 9 on an outer circumference of the funnel for deflecting the R. G. B beams emitted from the electron gun in a vertical or horizontal directions.

Referring to FIG. 2, the electron gun has a triode part and a main lens part. The triode part is provided with built-in heaters 4*a*, heat sources, three in-line cathodes 4*b*, a control electrode 4*c* for controlling thermal electrons emitted from the cathodes, and an accelerating electrode 4*d* for accelerating the thermal electrons, arranged in an order with certain gaps starting from the cathodes. The main lens part is provided with a focusing electrode 4*e* for focusing, and finally accelerating the R. G. B beams generated at the triode part, and an anode 4*f*. In the foregoing electron gun, there is a voltage difference occurred between the focusing electrode 4*e* and the anode 4*f* upon application of required voltages to respective electrodes, and the voltage difference forms an electrostatic lens between the electrodes. Accordingly, the R. G. B beams 3 from the triode part is focused in a course passing through the focusing electrode 4*e* and the anode 4*f* onto a center of the flourescent material coat by the electrostatic lens. In this instance, a self convergence deflection yoke 9 is come into operation for deflecting the R. G. B beams focused onto the center of the fluorescent material coat to an entire region of the screen.

A distribution of a magnetic field formed at the deflection yoke is as shown in FIGS. 3A and 3B. That is, a horizontal deflection magnetic field is formed in a pin cushion form, and a vertical deflection magnetic field is formed in a barrel form, for correction of mis-convergence in a peripheral region of the fluorescent material coat. As shown in FIGS. 3C and 3D, the horizontal deflection magnetic field and the vertical deflection magnetic field may be explained, with the horizontal deflection magnetic field and the vertical deflection magnetic field separated into two polar components and four polar components, respectively. That is, the two polar component deflects an electron beam in horizontal and vertical directions, and the four polar components converges the electron beam in a vertical direction and diverges in a horizontal direction. Therefore, even if a magnetic field is close to be uniform, the R. G. B beams receive substantial astigmatism in the peripheral region of the fluorescent material coat, such that a beam spot is distorted by fine pin cushion and barrel magnetic field components.

FIGS. 4A and 4B illustrate the electron beam spot distortion on a screen in more detail. That is, as there is no deflective magnetic field applied to the central portion of the screen, the electron beam spot shows no distortion. However, the R. G. B electron beams in the peripheral region are diverged in a horizontal direction and converged excessively in a vertical direction, the electron beams are elongated in horizontal direction substantially, and dispersed in up and down directions, to form a thin haze 11, that results in deterioration of the resolution in the peripheral region of the screen. This problem becomes the more serious as the CRT becomes the larger, and the deflection angle is the greater.

In order to solve the problem, in most cases of the related art, the astigmatism is corrected synchronous to a deflection signal when the electron beams are deflected toward the peripheral region of the screen, by providing a quadrupole between a first focusing electrode 41 and a second focusing electrode 42, which is provided by dividing the focusing electrode into two as shown in FIGS. 5A and 5B, that forms a quadrupole lens(see 13 in FIG. 6B). The system shown in FIGS. 5A and 5B is disclosed in U.S. Pat. No. 4,772,827, wherein the first focusing electrode 41 on the cathode side has electron beam pass through holes 41*a*, and vertical plate electrodes on both sides and between the electron beam pass through holes 41*a*. And, the second focusing electrode 42 having a high voltage applied thereto has horizontal plate electrodes 42*b* on upper and lower sides, and three electron beam pass through holes 42*a* corresponding to the electron beam pass through holes 41*a* in the first focusing electrode.

The operation of the foregoing electron gun will be explained with reference to FIGS. 5A~6B. The electron beams from the triode part(a beam forming region) pass through a first focusing electrode 41, a quadrupole part 41*b* on the first focusing electrode side, a quadrupole part 42*b* on the second focusing electrode side, and the second focusing electrode, and are focused at the eletrostatic lens 14 to form an image on the tube screen. Particularly, when the electron beam is deflected toward the peripheral region, though the first focusing electrode 41 is provided with a fixed static voltage, the second focusing electrode 42 is provided with a dynamic voltage varied with a required deflection of the electron beams. That is, as the voltages provided to the first focusing electrode 41 and the second focusing electrode 42 are provided to the quadrupole part 41*b* on the first focusing electrode side and the quadrupole part 42*b* on the second focusing electrode side, the quadrupole lens 13 is formed by the quadrupole, which corrects the astigmatism that affects the electron beams. In general, as a CRT becomes the larger, or the deflection angle becomes the greater, the dynamic voltage to the second focusing electrode is the higher than the static voltage to the first focusing electrode. A voltage difference between the first focusing electrode 41 and the second focusing electrode 42 form the quadrupole lens 13 at the quadrupole, which elongates the electron beams in a vertical direction. Accordingly, the quadrupole lens prevents the haze of the electron beams occurred when the electron beams are deflected to the peripheral region by a non-uniform magnetic field from the main lens 14 and the deflection yoke 9 in advance.

The quadrupole lens will be explained.

Referring to FIG. 6A, the electron beams 3 are focused at a central portion of the screen focused onto the central portion of the screen, the electron beams are not focused exactly due to a deflection aberration component when the electron beams are deflected to the peripheral region of the screen. And, portions shown in dashed lines on the drawing are an astigmatism component caused by the deflection yoke 9 when the electron beams are deflected to the peripheral region. A DY lens 12 formed by the deflection yoke 9 diverges the electron beams 3 in a horizontal direction and converges in a vertical direction. According to this, when the electron beams 3 are deflected to the peripheral region, an over-focusing component caused by a distance difference and an under-focusing component caused by the deflection yoke 9 are overlapped in the horizontal direction, to show a serious over-focusing, which results in a great dispersion of an image in the vertical direction, that deteriorates the resolution in the peripheral region. FIG. 6B illustrates the quadrupole lens added thereto for improving the above image dispersion, wherein it is shown that the astigmatism caused by the deflection yoke 9 is corrected by the quadrupole lens formed by the quadrupole. To do this, the quadrupole lens 13 is designed such that the electron beams are converged in the horizontal direction as much as a horizontal divergence caused by the deflection yoke and are diverged in the vertical direction as much as the vertical convergence caused by the deflection yoke. And, as shown in FIG. 6B, a lower dynamic voltage to a main lens forming electrode weakens the main lens, to permit the electron beams focused onto a point of the peripheral region in the horizontal/vertical directions. Thus, an appropriate quadrupole lens formed by, the dynamic voltage can provides an optimal focusing action to the peripheral region of the screen.

However, the use of the in-line self-convergence yoke in the related art electron gun in a CRT results in the R. G. B beams to have fixed spaces at a center of the deflection. According to this, the R beam and the B beam, side beams, become to have a deflection action different from the G beam, a center beam. That is, dynamic voltages provided to the R beam side and the B beam side are boosted for deflecting the R beam and the G beam more than the G beam, to achieve an exact convergence. The boosted dynamic voltages enlarge pixels of the side beams at the peripheral region of the screen, i.e., the side beam pixels become to have halo components. Though it is necessary to drop the dynamic voltages for improving the halo, the drop of the dynamic voltage causes a greater under focusing of the center beam, making the G beam, the center beam, more greater. The unbalance between the center beam and the side beams in the peripheral region deteriorates a resolution in the peripheral region of the screen even if the dynamic quadrupole lens is provided.

SUMMARY OF THE INVENTION

Accordingly, the present invention is directed to an electron gun in a color CRT that substantially obviates one or more of the problems due to limitations and disadvantages of the related art.

An object of the present invention is to provide an electron gun in a color CRT, which can enhance a resolution in a peripheral region of a screen.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the electron gun in a color CRT having a triode for emitting, controlling, and accelerating R, G, B beams, and main lens forming electrodes for focusing the R, G, B beams emitted from the triode onto a screen, includes first dynamic quadrupole lens forming electrodes for providing a vertical focusing action and a horizontal focusing action to be applied to the R, G, B beams, the vertical focusing action is different from the horizontal focusing action, and second dynamic quadrupole lens forming electrodes for, of the R, G, B beams, providing horizontal/vertical focusing actions to be applied to the R, B beams, side beams, and horizontal/vertical focusing actions to be applied to the G beam, a center beam, the horizontal/vertical focusing actions to be applied to the R, B beams are different from the horizontal/vertical focusing actions to be applied to the G beam, and the first dynamic quadrupole lens forming electrodes and the second dynamic quadrupole lens forming electrodes being arranged in an order starting from the main lens forming electrodes toward the triode.

In other aspect of the present invention, there is provided an electron gun in a color CRT having a triode for emitting, controlling, and accelerating R, G, B beams, and main lens forming electrodes for focusing the R, G, B beams emitted from the triode onto a screen, the electron gun including first dynamic quadrupole lens forming electrodes for providing a vertical focusing action and a horizontal focusing action to be applied to the R, G, B beams, the vertical focusing action is different from the horizontal focusing action, second dynamic quadrupole lens forming electrodes for, of the R, G, B beams, providing horizontal/vertical focusing actions to be applied to the R, B beams, side beams, and horizontal/vertical focusing actions to be applied to the G beam, a center beam, the horizontal/vertical focusing actions to be applied to the R, B beams are different from the horizontal/vertical focusing actions to be applied to the G beam, and third dynamic quadrupole lens forming electrodes for generating a focusing action opposite to the first dynamic quadrupole lens forming electrodes, the first dynamic quadrupole lens forming electrodes, the second dynamic quadrupole lens forming electrodes, and the third dynamic quadrupole lens forming electrodes being arranged in an order starting from the main lens forming electrodes toward the triode.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
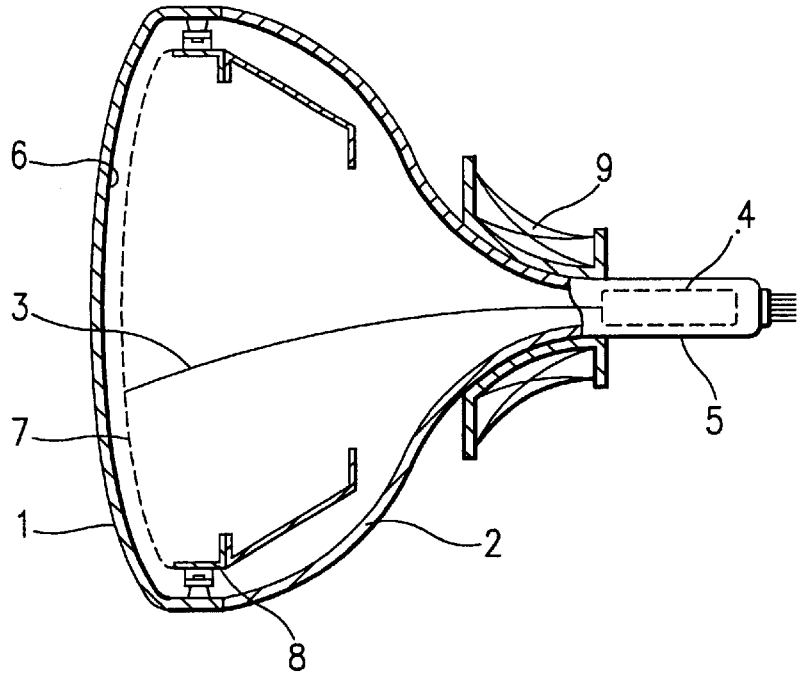
FIG.1 Prior Art
FIG. 1 illustrates a section of a related art CRT.
Figure 2:
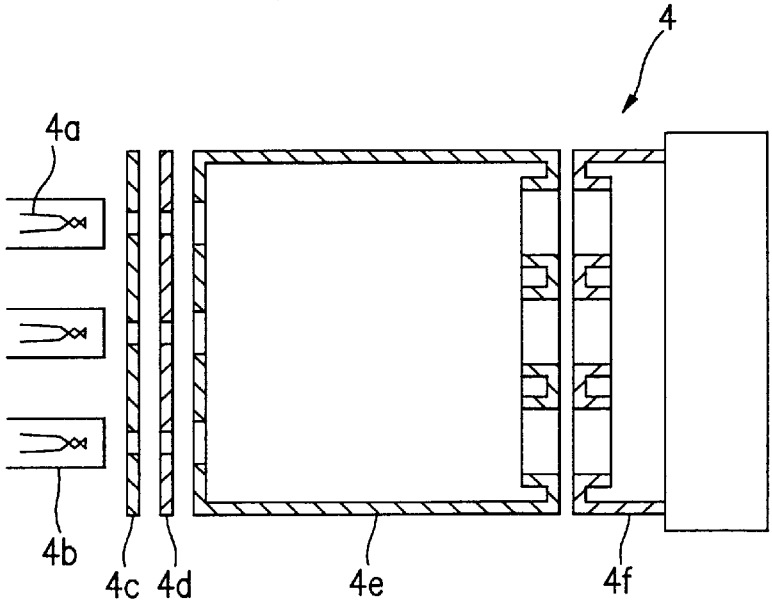
FIG.2 Prior Art
FIG. 2 illustrates a section of a related art electron gun.
Figure 3A:
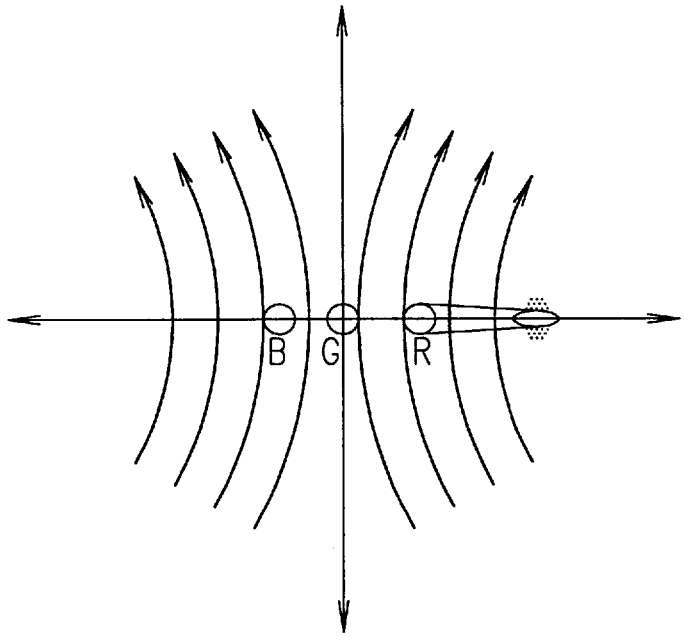
FIG.3A Prior Art
FIGS. 3A, 3B, 3C, and 3D illustrate distribution of magnetic fields formed by a related art deflection yoke.
Figure 3B:
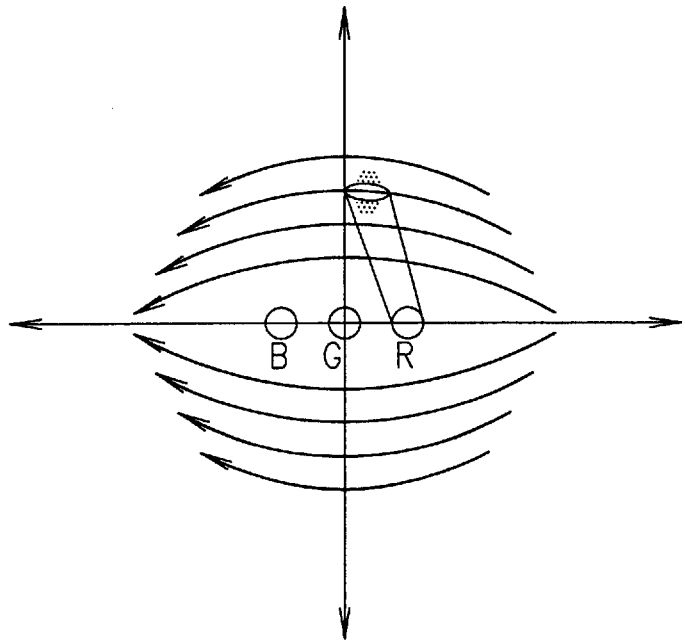
FIG.3B Prior Art
Figure 3C:
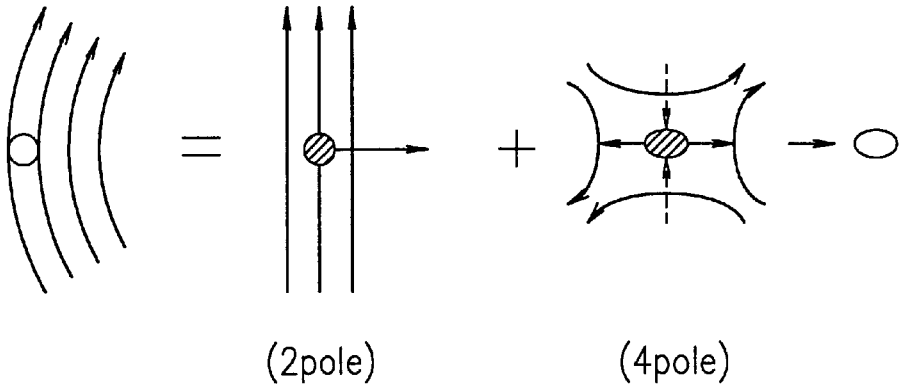
FIG.3C Prior Art
Figure 3D:
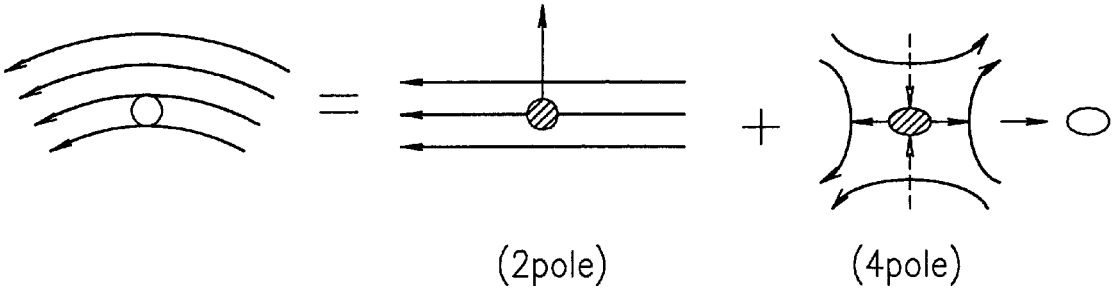
FIG.3D Prior Art
Figure 4A:
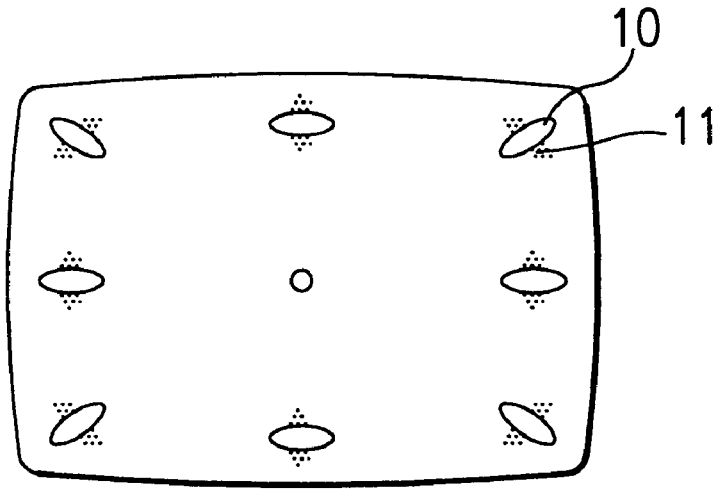
FIG.4A Prior Art
FIGS. 4A and 4B illustrate distortion states of electron spots in the related art.
Figure 4B:
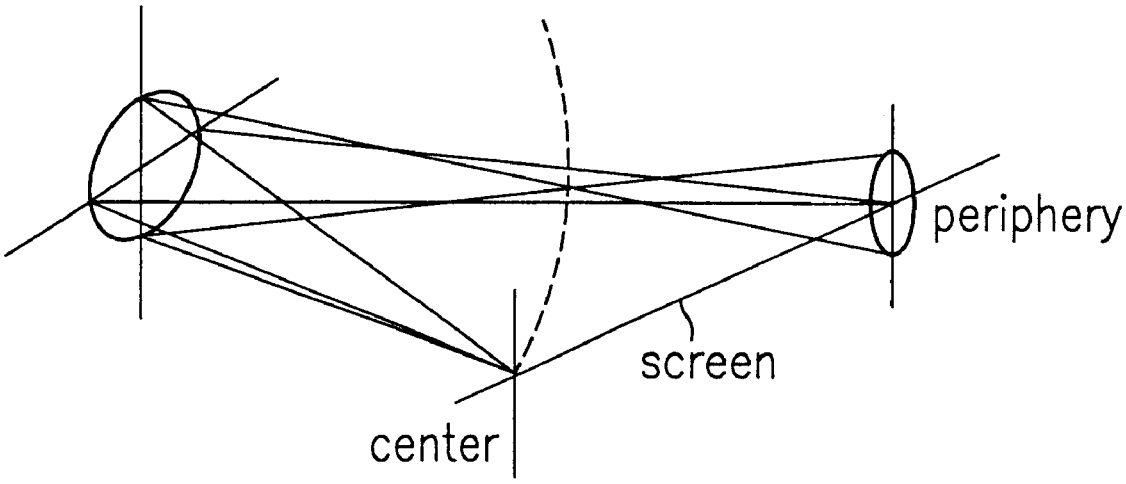
FIG.4B Prior Art
Figure 5A:
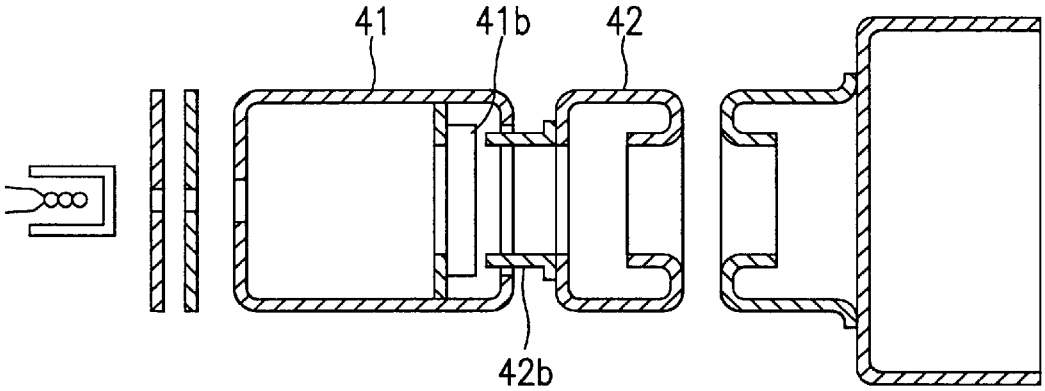
FIG.5A Prior Art
FIGS. 5A and 5B illustrate examples of internal structures of related art electron guns.
Figure 5B:
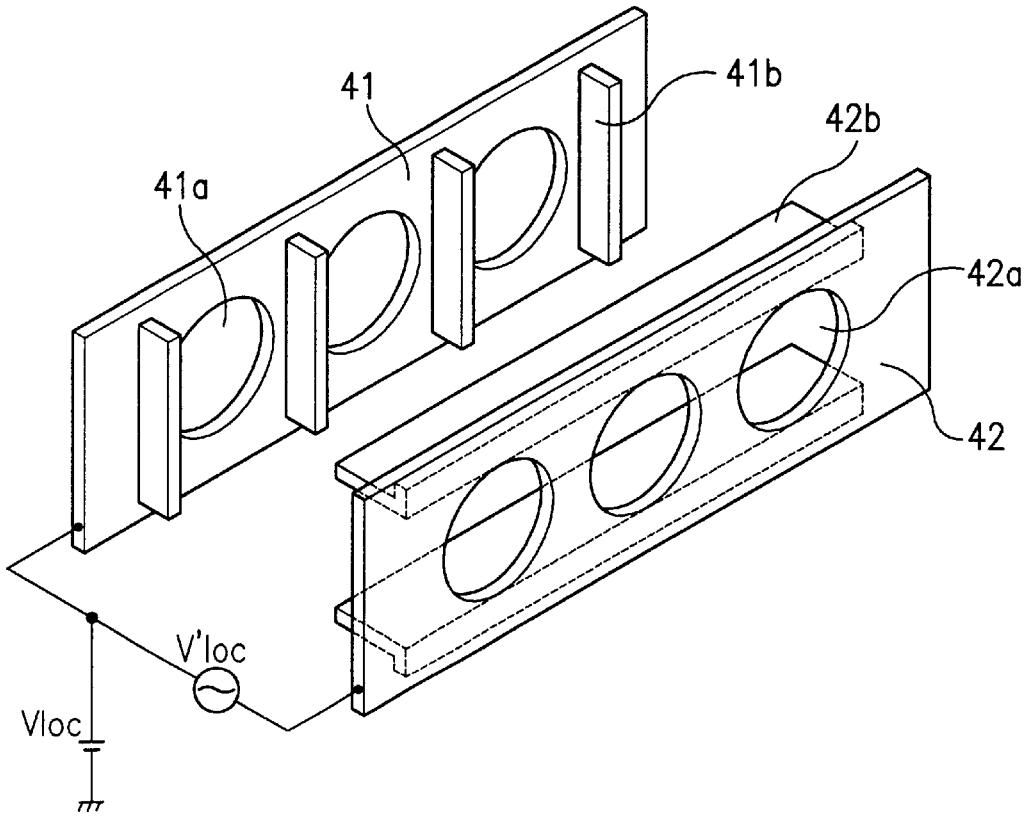
FIG.5B Prior Art
Figure 6A:
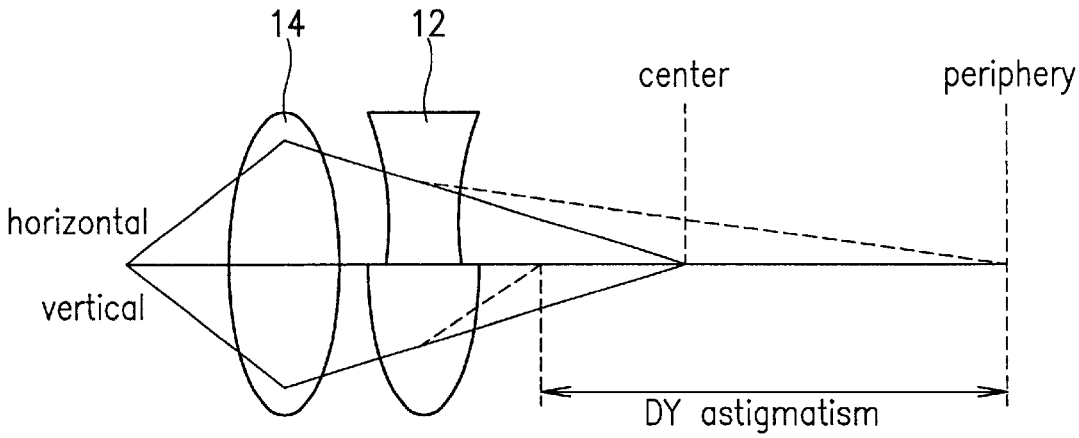
FIG.6A Prior Art
FIG. 6A illustrates a focusing state of electron beams onto a screen when a dynamic quadrupole lens is not applied.
Figure 6B:
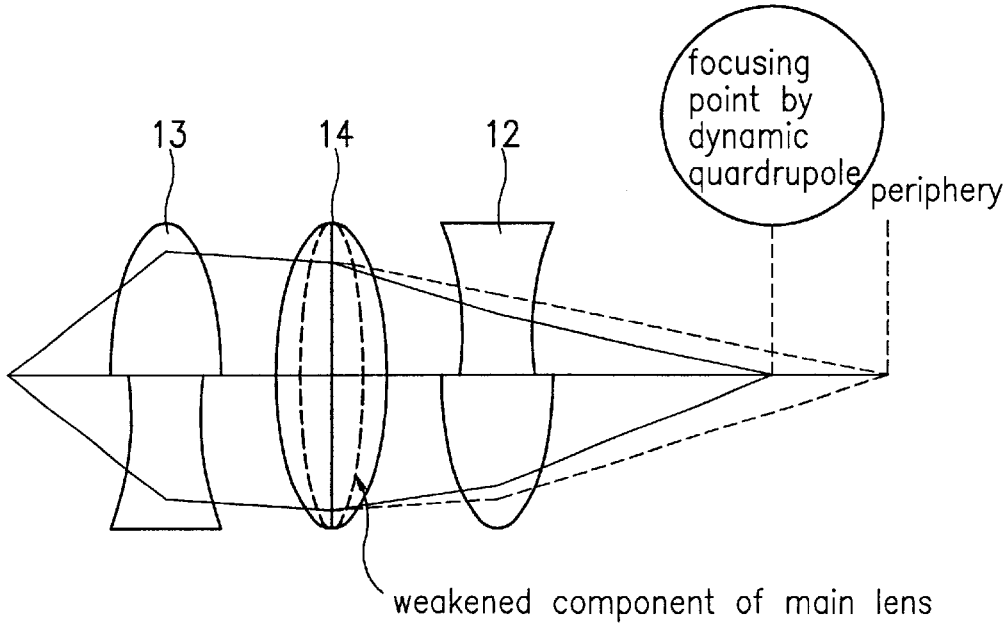
FIG.6B Prior Art
FIG. 6B illustrates a focusing state of electron beams onto a screen when a dynamic quadrupole lens is applied.
Figure 7:
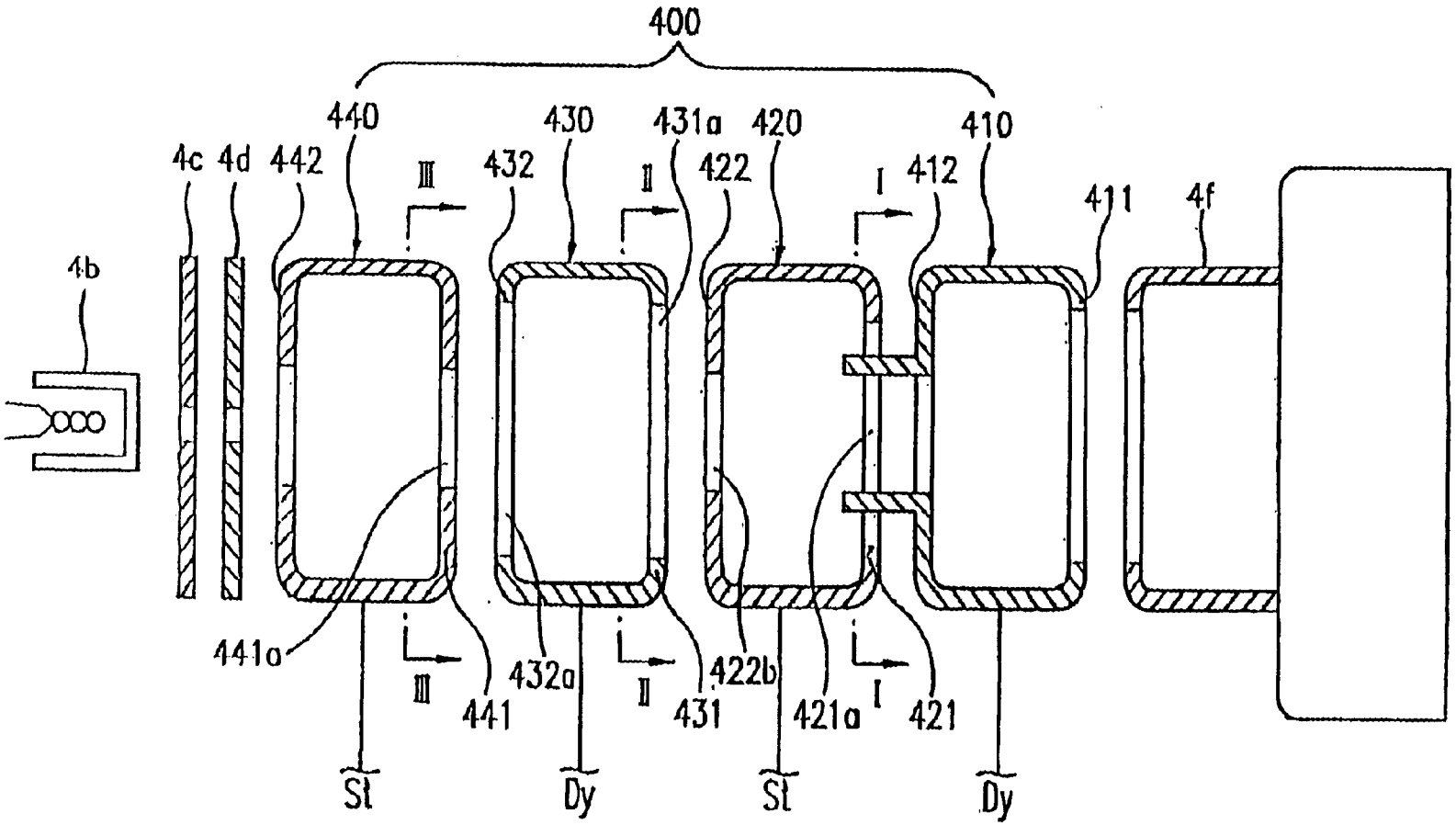
FIG. 7 illustrates a section of an electron gun in accordance with a preferred embodiment of the present invention.

Reference will now be made in detail to the preferred embodiment of the present invention, examples of which are illustrated in FIGS. 7~9C. An electron gun in a color CRT in accordance with a preferred embodiment of the present invention includes a first dynamic quadrupole lens 131 caused to be formed near to a main lens unit 130 having a difference of vertical and horizontal focusing actions, and a second dynamic quadrupole lens 132 on an electron beam R, G, and B emission means of the first dynamic quadrupole lens. And, the side beam pass through holes in the second dynamic quadrupole lens forming electrode are formed so that horizontal and vertical focusing actions of each of the side beam pass through holes are different from the horizontal and vertical focusing actions of the center beam pass through hole. And, there is a third dynamic quadrupole lens 133 formed on an electron beam emission means side of the second dynamic quadrupole lens. The focusing electrode 400 in the main lens part is divided into a plurality of focusing electrodes disposed at fixed intervals, to which voltage applying device(not shown) is connected, for selective application of dynamic or static voltages, respectively. Detailed explanations of the voltage applying device will be omitted since the voltage applying device has the same system and operation principle with the related art. The voltage applying device is arranged such that a dynamic voltage is applied to a first focusing electrode 410 disposed closest to the anode, a static voltage is applied to a second focusing electrode 420 next to the first focusing electrode 410, a dynamic voltage is applied to a third focusing electrode 430 disposed next to the second focusing electrode 420, and a static voltage is applied to a fourth focusing electrode 440 disposed next to the third focusing electrode 430. As explained, the voltage applying device is designed to apply appropriate voltages different from each other to respective focusing electrodes at appropriate times. Eventually, the foregoing system permits to form the main lens between the first focusing electrode 410 and the anode 4*f*, the first dynamic quadrupole lens 131 between the first focusing electrode 410 and the second focusing electrode 420, a second dynamic quadrupole lens 132 between the second focusing electrode 420 and the third focusing electrode 430, and the third dynamic quadrupole lens 133 between the third focusing electrode 430 and the fourth focusing electrode 440. Each of the focusing electrodes is a combination of a cap and a cup, wherein the cup and the cap have electron beam pass through holes of forms different or the same with each other, for providing the dynamic quadrupole lenses 131, 132, 133 having lens actions different from each other.

Forms of the foregoing electron beam pass through holes will be explained with reference to FIGS. 8A~8D.

Since the electron beam pass through holes in the cap (called "a first cap")(see 411 in FIG. 7) of the first focusing electrode are identical with the electron beam pass through holes in the anode, detailed explanations of the electron beam pass through holes will be omitted. The electron beam though holes in the cup(called "a first cup") 412 of the first focusing electrode correspond to the electron beam pass through holes in the cap(called "a second cap") 421 of the second focusing electrode, and have plate form or circular form electrode pieces 412*a* projected from upper and lower portions thereof. The electron through holes 421*a* in the second cap have forms of vertically elongated holes each having a vertical side greater than a horizontal side or forms of rectangular holes, in which respective electrode pieces 412*a* in the first cup 312 are inserted. Particularly, as shown in the drawing, the forms of the vertically elongated holes are inclusive of forms of key-holes. The forms of key-holes described hereafter may be replaced with forms of vertically elongated holes. Of the electron beam pass through holes in the cup(called "a second cup") 422 of the second focusing electrode and in the cap(called "a third cap") 431 of the third focusing electrode, side beam pass through holes 422*a* and 431 a in the outer sides are circular for providing the same vertical and horizontal focusing actions, and center beam pass through holes 422*b* and 431*b* at the centers are of key hole or rectangular for providing vertical and horizontal focusing actions different from each other. Of the electron beam pass through holes in the second cup 422 and the third cup 431 where the second quadrupole lens is formed, the outer electron beam pass through holes 422*a* and 431*a* may not be circular necessarily, but be holes each having a length greater than a width. Each of the electron beam pass through holes 432*a* in the cup(called as "a third cup") of the third focusing electrode where the third quadrupole lens is formed has a length greater than a width, and each of the electron beam pass through holes 441 a in the cap(called as "a fourth cap") of the fourth focusing electrode has a width greater than a length. According to this, the main lens 130 formed between the first focusing electrode and the anode has a horizontal focusing action greater than a vertical focusing action.

The operation of the electron gun in a color CRT of the present invention will be explained in detail.

Figure 8A:
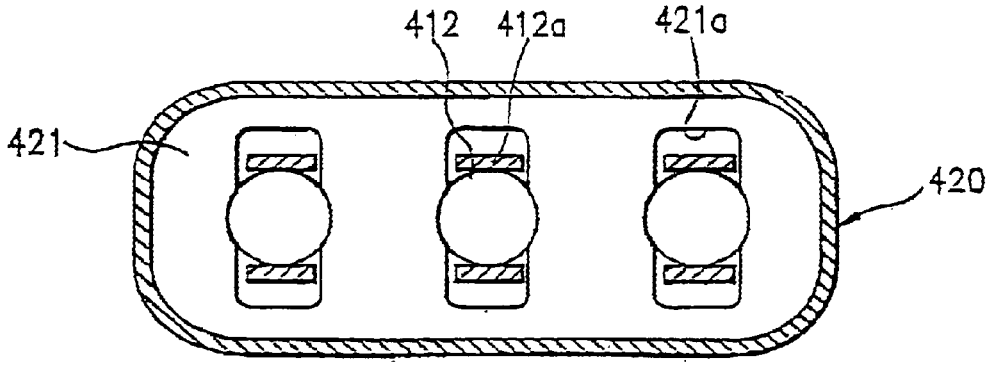
FIG. 8A illustrates a section across a line I—I in FIG. 7.
Figure 8B:
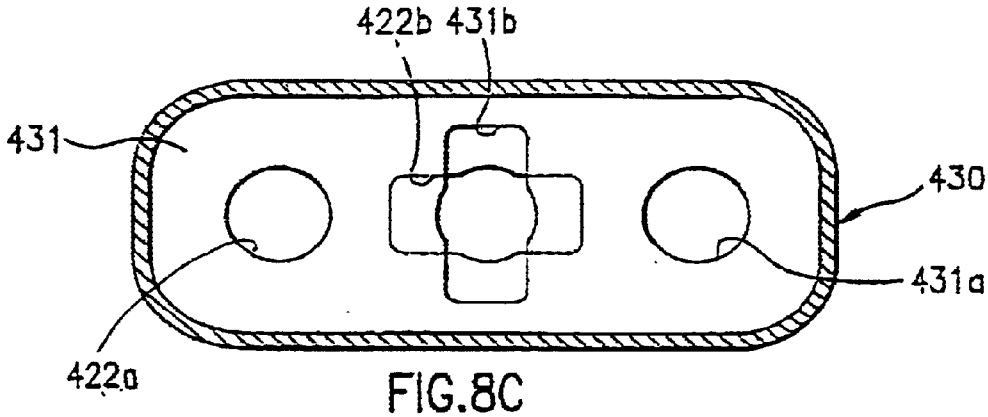
FIG. 8B illustrates a section across a line II—11 in FIG. 7.
Figure 8C:
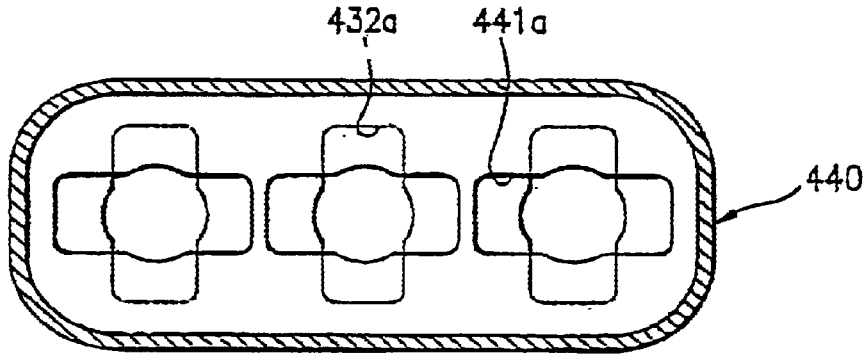
FIG. 8C illustrates a section across a line III—III in FIG. 7.
Figure 8D:
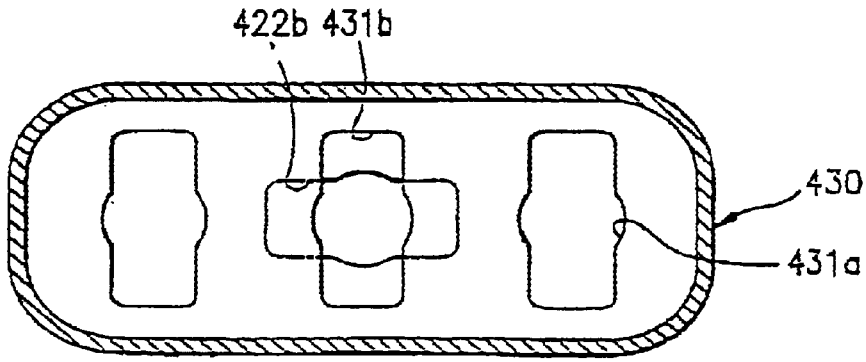
FIG. 8D illustrates another embodiment of FIG. 8B.
Figure 9A:
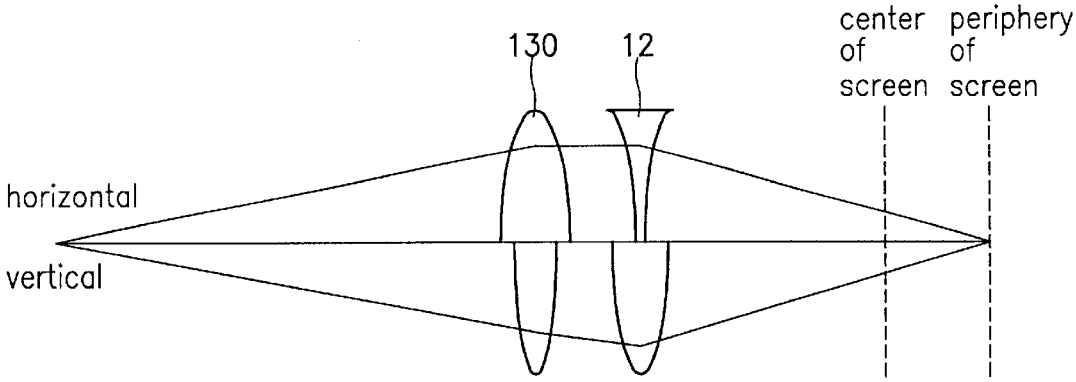
FIGS. 9A, 9B and 9C illustrate focusing states of electron beams onto a screen.
Figure 9B:
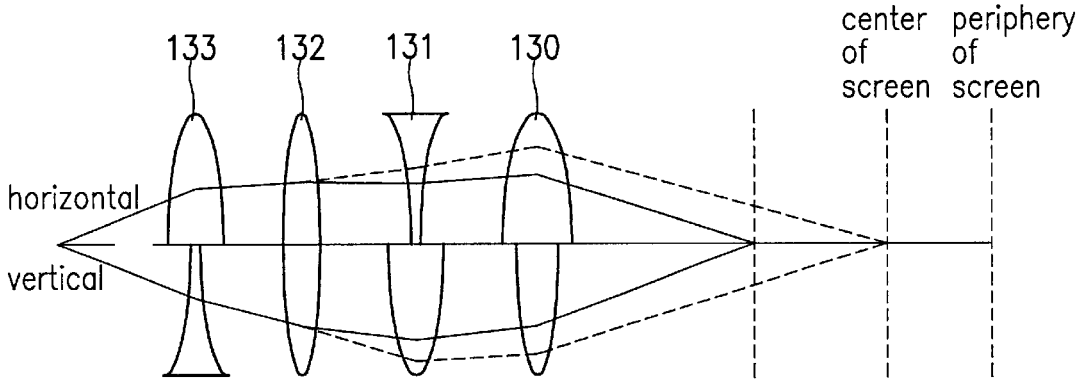
Figure 9C:
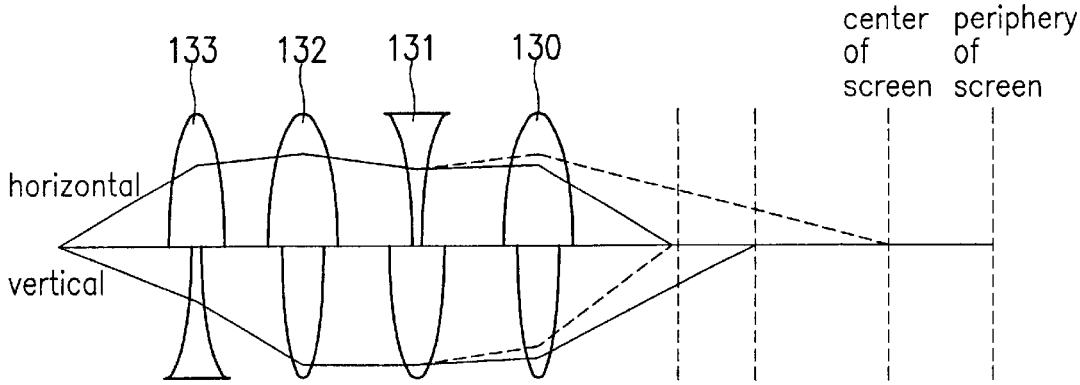

When the static voltages and the dynamic voltages are set identical by controlling the voltage supply device, to deflect the electron beams to the peripheral region of the screen, just of the electron beams are matched in the peripheral region of the screen. In this instance, as shown in FIG. 9A, only the main lens 130 and the yoke lens DY are activated, but not the first, second, and third quadrupole lenses 131, 132, and 133. In order to direct the electron beams to a center of the screen under this state, the dynamic voltages should be dropped lower than the static voltages by controlling the voltage supply device, when the yoke lens DY is not in action. That is, the operation is carried out opposite to a related art method in which, after just of the electron beams is matched at the center of the screen initially, the dynamic voltages are boosted gradually for improving the electron beams at the peripheral region of the screen. According to this, action of the G beam, the center beam, and the R and B beams, side beams, can be made different from each other. That is, a lens action at a center of the main lens onto which the center beam is focused is stronger than a lens action at a periphery of the main lens 130 onto which the side beams are focused. And, in this instance, voltage differences between respective focusing electrodes 410, 420, 430, and 440 cause to form the quadrupole lenses 131, 132 and 133. It is preferable that the lens actions of the dynamic quadrupole lenses 131, 132 and 133 differ. That is, a dynamic voltage is provided to the first focusing electrode 410, and a static voltage higher than the dynamic voltage provided to the first focusing electrode is provided to the second focusing electrode 420, to cause a voltage difference which forms the first dynamic quadrupole lens 131, that makes a diverging action in a horizontal direction and converging action in a vertical direction. This is because the electron beam pass through holes 421*a* in the second cap 421 have lengths greater than widths respectively, and the electron beam pass through holes in the first cup 412 have the upper and lower electrode pieces 412*a*. As a dynamic voltage is provided to the third focusing electrode 430, the second dynamic quadrupole lens 132 is formed between the second and the third focusing electrode, such that the side beams have the same focusing actions in vertical and horizontal directions, while the center beam is converged in a horizontal direction, and diverged in a vertical direction. This is because the center electron beam pass through hole 431*b* in the third cap 431 has a length greater than a width, and the center electron beam pass through hole 422*b* in the second cup 422 is rectangular key hole with a width greater than a length. And, as the fourth focusing electrode 440 is provided with a static voltage, the third dynamic quadrupole lens 133 between the third focusing electrode and the fourth focusing electrode has a converging action in a horizontal direction, and a diverging action in a vertical direction. This is because the fourth cap 441 has the electron beam pass through holes 441*a* each with a width greater than a length, and the third cup 431 has the electron beam pass through holes 432*a* each with a width greater than a length. That is, the third dynamic quadrupole lens 133 acts opposite to the first dynamic quadrupole lens 131, and the lens actions of the center electron beam pass through holes and the lens actions of the side electron beam pass through holes in the respective electrodes of the third dynamic quadrupole lens differ. As shown in FIG. 9B, the appropriate deflection of the electron beams made available by the quadrupole lenses between the focusing electrodes according to the aforementioned actions permits to form a clear image even at the center of the screen. For dropping the dynamic voltages provided to respective focusing electrodes, forms of the electron beam pass through holes between the second focusing electrode and the third focusing electrode which form the second dynamic quadrupole lens may be changed. That is, as shown in FIG. 8D, of the electron beam pass through holes in the second cup and in the third cap, by forming each of the outer electron beam pass through holes to have a length greater than a width, the vertical focusing action of the second quadrupole lens can be made more stronger to form the image at a point further forward in the horizontal direction as shown in FIG. 9C.

The electron gun in a color CRT of the present invention is not limited to a system in which the focusing electrode is divided into four, to form three dynamic quadrupole lenses. That is, even if two dynamic quadrupole lenses are formed the same as the related art, the same effect can be obtained, only when the outer electron beam pass through holes in the second dynamic quadrupole lens forming electrodes should have the same vertical and horizontal focusing actions, and the center beam pass through holes therein should have a converging action in the horizontal direction and a diverging action in the vertical direction. As explained in the aforementioned embodiment, this can be made possible by forming key hole form or rectangular form center beam pass through holes in directions to cross each other in the opposite electrodes which form the second dynamic quadrupole lens, and side beam pass through holes of a form circular or rectangular with a length greater than a width, so that lens actions of the center beam pass through holes and the fens actions of the side beam pass through holes of the electrodes which form the first dynamic quadrupole lens and the second dynamic quadrupole lens respectively differ. That is, as far as a fashion of providing the dynamic voltages and the static voltages to respective focusing electrodes is made different for matching the central portion of the screen after the just is matched in a peripheral region of the screen initially, and forms of respective electron beam pass through holes are provided exactly such that forms of respective quadrupole lenses are changed as the dynamic voltages are lowered below the static voltages, a number of the dynamic quadrupole lenses of being two, or three or more than three does not matters.

As has been explained, by multiple dividing the focusing electrode, and providing dynamic voltages and static voltages to respective focusing electrodes selectively, and appropriate change of forms and arrangement of the electron beam pass through holes in the focusing electrodes, resolutions in the central portion and the peripheral portion of the screen can be enhanced even if a low dynamic voltages are provided. And, by designing to provide the dynamic voltages lower than the static voltages, boosting of the dynamic voltages of the related art can be prevented appropriately, and astigmatism can be compensated.

It will be apparent to those skilled in the art that various modifications and variations can be made in the electron gun in a color CRT of the present invention without departing from the spirit or scope of the invention. Thus, it is intended that the present invention cover the modifications and variations of this invention provided they come within the scope of the appended claims and their equivalents.

What is claimed is:

1. An electron gun in a color CRT(Cathode Ray Tube), the electron gun having a triode for emitting, controlling, and accelerating R, G, B beams, and main lens forming electrodes for focusing the R, G, B beams emitted from the triode onto a screen, the electron gun comprising:

first dynamic quadrupole lens forming electrodes;

second dynamic quadrupole lens forming electrodes for providing horizontal and vertical focusing actions to be applied to the R, G, B beams by applying a dynamic voltage thereto; and third dynamic quadrupole lens forming electrodes for generating a focusing action opposite to the first dynamic quadrupole lens forming electrodes, wherein the first dynamic quadrupole lens forming electrodes, the second dynamic quadrupole lens forming electrodes, and the third dynamic quadrupole lens forming electrodes are arranged in order starting from the main lens forming electrodes toward the triode.

2. The electron gun as claimed in claim 1, wherein the second dynamic quadrupole lens forming electrodes include opposite surfaces each having a center beam pass through hole for converging the G beam in a horizontal direction and diverging the G beam in a vertical direction, and side beam pass through holes for converging the R, B beams in the vertical and horizontal directions in identical fashion.

3. The electron gun as claimed in claim 2, wherein the center beam pass through hole of the second dynamic quadrupole lens forming electrodes each have a vertically elongated hole form, and the side beam pass through hole of the second dynamic quadrupole lens forming electrodes each have a circular form.

4. The electron gun as claimed in claim 2, wherein the center beam pass through hole of the second dynamic quadrupole lens forming electrodes each have a key hole form, and the side beam pass through hole of the second dynamic quadrupole lens forming electrodes each have a circular form.

5. The electron gun as claimed in claim 2, wherein the center beam pass through hole of the second dynamic quadrupole lens forming electrodes each have a rectangular form, and the side beam pass through hole of the second dynamic quadrupole lens forming electrodes each have a circular form.

6. The electron gun as claimed in claim 2, wherein opposite center beam pass through holes of the second dynamic quadrupole lens forming electrodes have one vertically elongated hole form and one horizontally elongated hole form arranged to cross each other, and the side beam pass through hole have a form with a length greater than a width.

7. The electron gun as claimed in claim 2, wherein opposite center beam pass through holes of the second dynamic quadrupole lens forming electrodes have key hole forms arranged to cross each other, and the side beam pass through hole have a form with a length greater than a width.

8. The electron gun as claimed in claim 7, wherein the opposite center beam pass through holes have rectangular forms arranged to cross each other, and the side beam pass through hole have a form with a length greater than a width.

9. The electron gun as claimed in claim 1, wherein lens actions of the center beam pass through holes are different from the lens actions of the side beam pas through holes in the first dynamic quadrupole lens forming electrodes and the second dynamic quadrupole lens forming electrodes, respectively.

10. The electron gun as claimed in claim 1, wherein, in opposite surfaces of the third dynamic quadrupole lens forming electrodes, there are beam pass through holes arranged to cross each other such that a hole with a length greater than a width is arranged opposite to a hole with a length smaller than a width, so that the R, G, B beams are focused opposite to the focusing at the first dynamic quadrupole lens forming electrodes.

11. The electron gun as claimed in claim 1, wherein, in the third dynamic quadrupole lens forming electrodes, actions of the lenses formed at the G beam, a center beam, are different from the actions of the lenses formed at the R, B beams, side beams.

12. The electron gun as claimed in claim 1, wherein lens actions at the center beam pass through holes ate different from lens actions at the side beam pass through holes in the first, second, and third dynamic quadrupole lens forming electrodes, respectively.

13. The electron gun as claimed in claim 1, wherein a static voltage applied to the first, second, and third quadrupole lens forming electrodes, respectively, is greater than the dynamic voltage applied thereto.

14. The electron gun as claimed in claim 1, wherein the first dynamic quadrupole lens forming electrodes, the second dynamic quadrupole lens forming electrodes, and the third dynamic quadrupole lens forming electrodes collectively focus the beams onto a center of the screen.

15. An electron gun in a color CRT (Cathode Ray Tube), the electron gun having a triode for emitting, controlling, and accelerating R, G, B beams, and main lens forming electrodes for focusing the R, G, B beams emitted from the triode onto a screen, the electron gun comprising:

first dynamic quadrupole lens forming electrodes for diverging the beams in a horizontal direction and converging the beams in a vertical direction;

second dynamic quadrupole lens forming electrodes for providing horizontal and/or vertical focusing action to be applied to the beams by applying a dynamic voltage thereto;

third dynamic quadrupole lens forming electrodes for converging the beams in the horizontal direction and diverging the beams in the vertical direction, wherein the first dynamic quadrupole lens forming electrodes, the second dynamic quadrupole lens forming electrodes, and the third dynamic quadrupole lens forming electrodes are arranged in order starting from the main lens forming electrodes toward the triode, and wherein lens actions of a center beam pass through hole is different from lens actions of side beam pass through holes in the second dynamic quadrupole lens forming electrodes.

16. The electron gun as claimed in claim 15, wherein a static voltage applied to the first, second, and third quadrupole lens forming electrodes, respectively, is greater than the dynamic voltage applied thereto.

17. The electron gun as claimed in claim 15, wherein the first dynamic quadrupole lens forming electrodes, the second dynamic quadrupole lens forming electrodes, and the third dynamic quadrupole lens forming electrodes collectively focus the beams onto a center of the screen.

18. The electron gun as claimed in claim 1, wherein the horizontal and vertical focusing actions of the second dynamic quadrupole lens forming electrodes are different from the focusing actions of the first dynamic quadrupole lens forming electrodes and the third dynamic quadrupole lens forming electrode.

* * * * *